US007238920B1

(12) United States Patent
Prieto et al.

(10) Patent No.: US 7,238,920 B1
(45) Date of Patent: Jul. 3, 2007

(54) MODULAR BAT WARMING SYSTEM

(76) Inventors: Fernando Prieto, 75 Saint David Way, Wellington, FL (US) 33414; David Prieto, 75 Saint David Way, Wellington, FL (US) 33414

( * ) Notice: Subject to any disclaimer, the term of this patent is extended or adjusted under 35 U.S.C. 154(b) by 0 days.

(21) Appl. No.: 11/341,736

(22) Filed: Jan. 27, 2006

(51) Int. Cl.
*H05B 3/02* (2006.01)
*F27D 1/00* (2006.01)
*F27D 11/00* (2006.01)

(52) U.S. Cl. ..... 219/386; 219/405; 219/411; 392/416; 392/418; 392/423; 392/425

(58) Field of Classification Search ..... None
See application file for complete search history.

(56) References Cited

U.S. PATENT DOCUMENTS

| | | | | |
|---|---|---|---|---|
| 1,499,128 | A | 6/1924 | Shroyer, Jr. | |
| 3,707,279 | A | 12/1972 | Kaiser | |
| 3,800,863 | A | 4/1974 | Bauman, Jr. | |
| 4,065,660 | A * | 12/1977 | Berard | 219/535 |
| 5,057,670 | A | 10/1991 | Cohen | |
| 5,062,528 | A | 11/1991 | Whitaker, Jr. | |
| 5,341,927 | A | 8/1994 | Coyner | |
| 5,436,429 | A * | 7/1995 | Cline | 219/202 |
| 5,615,805 | A * | 4/1997 | Yoncak | 222/146.5 |
| 5,687,705 | A | 11/1997 | Blair | |
| 5,786,574 | A | 7/1998 | Garnett | |
| 5,834,738 | A | 11/1998 | Wilson | |
| 6,130,411 | A | 10/2000 | Rockenfeller et al. | |
| 6,196,217 | B1 | 3/2001 | Smith | |
| 6,222,159 | B1 | 4/2001 | Healy | |
| 6,229,132 | B1 | 5/2001 | Knetter | |
| 6,247,469 | B1 | 6/2001 | Guard | |
| 6,263,591 | B1 | 7/2001 | La Porte | |
| 6,353,211 | B1 * | 3/2002 | Chen | 219/527 |
| 6,681,821 | B1 | 1/2004 | Cirone | |
| 6,870,135 | B2 * | 3/2005 | Hamm et al. | 219/386 |
| 2004/0178186 | A1 * | 9/2004 | Lu | 219/438 |

* cited by examiner

*Primary Examiner*—Joseph Pelham
(74) *Attorney, Agent, or Firm*—McHale & Slavin, P.A.

(57) ABSTRACT

Disclosed is a baseball and/or softball bat warmer system. Each individual bat heater includes an elongated outer tubular member having a closed bottom surface. An inner tubular member is spaced inwardly from the outer tubular member forming a space therebetween. A radiation type heating element is positioned between the inner and outer members so that it extends around the barrel portion of the bat for even heating thereof. The system also utilizes a heat seal positioned on the upper portion of the outer tubular member to protect the handle and grip portion of the bat from excessive heat.

14 Claims, 5 Drawing Sheets

MODULAR BAT WARMING SYSTEM

FIELD OF THE INVENTION

This invention relates to a device and system for warming baseball or softball bats above ambient temperature.

PRIOR ART BACKGROUND

Baseball bats in the early days of baseball came in all shapes and sizes. In the 1850's, baseball was a very young sport and players often made their own bats. Because bats of all shapes and sizes were being used, a rule was made limiting bats to 2.5 inches in diameter, although they could be of any length. Ten years later another rule was added limiting bat length to 42 inches, the same maximum length allowed today. In 1890, another rule was added requiring bats to be round in shape and increasing the maximum diameter to 2.75 inches.

In 1924, U.S. Pat. No. 1,499,128 issued for a metal baseball bat. Aluminum bats began to be utilized in baseball play about 1970. Although aluminum bats do not provide the traditional "crack of the bat" sound of wooden bats, they have become far more popular than wooden bats in leagues that allow their use. One advantage of aluminum, or other types of metal, bats is that they are lighter and stronger than wood bats. Another advantage relates to the "spring effect" that occurs when a ball is hit with a metal bat. The spring effect occurs when the thin metal wall of the bat flexes upon contact with the ball, increasing the speed at which the ball leaves the bat.

However, when temperatures drop below about 60° F. metal bats incur numerous drawbacks. Colder temperatures reduce the elasticity of the bat material thus reducing their performance. In addition, metal bats tend to dent and/or crack when used in colder temperatures reducing their useful life. Because most metal bats utilize expensive metal alloys and require difficult manufacturing processes they are often expensive to purchase or replace.

Therefore, there have been attempts in the art to improve the performance and extend the useful life of metal bats when used in cold weather environments. For example, U.S. Pat. No. 5,786,574 discloses a cylindrical insulated sleeve that uses a battery to supply direct current to a heating wire to warm a baseball bat.

U.S. Pat. No. 6,247,469 discloses a warmer for a sporting element. The device includes a pouch constructed of an inner thermally conductive cloth layer and an outer cloth layer of thermally insulating material. An intermediate layer of a microwave heatable substance is placed between the inner and outer layers for heating a bat.

U.S. Pat. No. 6,229,132 discloses a sporting equipment warmer having a microwaveable heat source. The device includes a flexible cloth pouch sized and shaped to accept a bat. A microwaveable heat source is placed within the pouch cavity to transfer heat to the item placed inside.

U.S. Pat. No. 6,196,217 discloses a solar powered bat warmer. The device includes a container having four sides, a top and a bottom. One side is constructed of a plexiglass material and an opposite side includes a support to permit the container to be angled for collecting the sun's rays.

While these devices are suitable for warming bats in limited circumstances, they generally suffer from numerous drawbacks. The microwave heated elements are only capable of providing heat for a limited amount of time. Microwave ovens are generally not available in baseball or softball field dugouts. Therefore, if travel is required to get to the field or if there is a delay in the start time of the game these devices may cease to provide heat to the bat. The battery powered devices are only capable of providing a very limited amount of heat. In addition, the substantial drain on the batteries forces a user to change them often.

It is also known in the art to provide an enclosure into which the entire bat may be placed and heated. For example, U.S. Pat. No. 5,687,705 discloses an aluminum baseball or softball bat warmer. The device includes an inner and an outer container separated by an air space. The inner container is constructed to receive a bat and is supported inside of the outer container on a hanger. A convective heat source is positioned below the hanger. Warmed air from the convective heat source is directed through an aperture in the hanger to warm the inner container and the bat therein.

U.S. Pat. No. 6,222,159 discloses a warmer for baseball bats. The device consists of an enclosure with capped, suspended, open ended tubes for receiving multiple bats in a vertical position. The tubes are retained on a height-adjusting grate. A convective thermal heat source is positioned below the retaining grate. Warmed air from the heat source rises through the grate heating the bats in the capped cavities above.

While these devices are effective for heating bats, they suffer from numerous drawbacks that have not been addressed in the prior art. One such drawback relates to the method of transferring heat energy from the heat source to the bat. The prior art utilizes convection heat sources positioned below the bat(s) within the enclosure. This method of heating generally results in excessive temperatures at the distal ends of the bat. Heat transfer to the remainder of the bat relies on conduction through the bat material. Because convective heat rises, the grip portion of the bat is excessively heated. This portion of the bat is not constructed to withstand repeated exposure to heat. Repeated heat cycles cause a loss of plasticizers within the resilient grip portion causing it to become dry and/or brittle. This shortens the useful life of the bat by requiring the grip portion to be replaced at short intervals. Because the grip portion is often molded around the handle of the bat this may be impractical and require the bat to be replaced.

Therefore what is needed in the art is a modular bat heating system that is capable of selectively heating the barrel portion of the bat via a radiation heat source while isolating the handle and grip portion of the bat from excessive heat. The system should provide a modular design that allows for heating one bat or a plurality of bats. The system should provide portability and allow for fixed placement if desired.

SUMMARY OF THE PRESENT INVENTION

Briefly, disclosed is a baseball and/or softball bat warmer system. Each individual bat heater includes an elongated outer tubular member having a closed bottom surface. An inner tubular member is spaced inwardly from the outer tubular member forming a space therebetween. A radiation type heating element is positioned between the inner and outer members so that it extends around the barrel portion of the bat for even heating thereof. The system also utilizes a heat seal positioned on the upper portion of the outer tubular member to protect the handle and grip portion of the bat from excessive heat. The heat seal is a flexible member extending inwardly from the outer tubular member having a centrally located aperture constructed to fit tightly around the area of the bat adjacent to the handle. In addition, the heat seal permits a bat to be quickly inserted or removed from the device without opening or closing an enclosure lid or door. The bat merely needs to be pushed through the central aperture to place the bat within the warmer or pulled upwardly to remove the bat from the warmer. In one embodiment the instant invention includes at least one rail constructed and arranged for mounting a plurality of bat warmers thereto in a substantially linear arrangement.

Therefore, it is an objective of this invention to provide a modular bat warming system.

It is another objective of the instant invention to provide a bat warmer that utilizes radiant heat to heat a bat above ambient temperature.

It is a further objective of the instant invention to provide a bat warmer that utilizes a heat seal to prevent excessive heat transfer to the handle portion of the bat.

It is yet another objective of the instant invention to provide a bat warmer that allows easy insertion and removal of a bat from the warmer.

It is still yet another objective of the instant invention to provide a bat warming system that allows heating one or a plurality of bats simultaneously.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

DETAILED DESCRIPTION OF THE INVENTION

Figure 2:
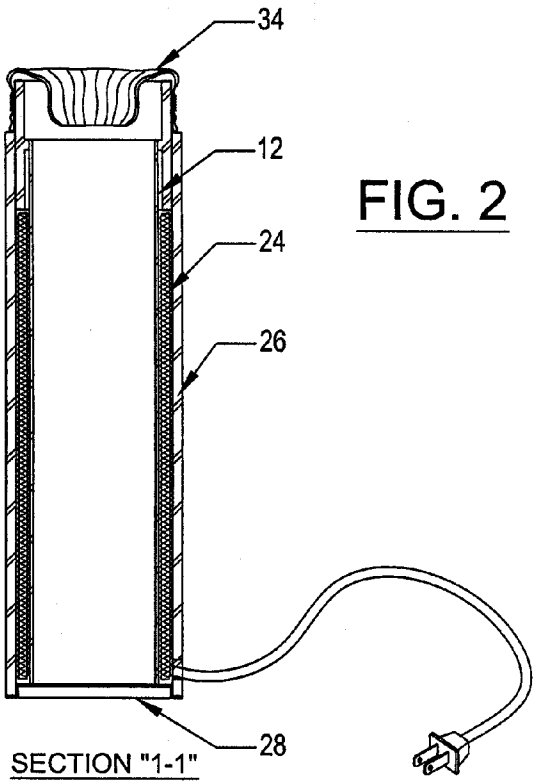
FIG. 2 is a section view taken along line 1-1 of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to the Figures, a bat warmer 10 for warming a metal baseball or softball bat 11 is shown. The bat warmer includes an inner tubular member 12 constructed and arranged to conduct thermal radiation therethrough. The inner tubular member preferably includes an open top end 14, an open bottom end 16, an outer surface 18 and an inner surface 20 defining an inner diameter. The inner diameter is sized to fit around, and has a length sufficient to accept, an outer surface of the barrel portion 22 of a bat member. The inner tubular member is preferably constructed of aluminum having a mat or dull finish for increased radiant heat transfer. Alternatively, the inner tubular member may be constructed of any metal, refractory or polymeric material suitable for transferring radiant heat from the heating element to the barrel portion of the bat. Suitable materials include, but should not be limited to brass, copper, iron, steel, zinc, carbon, gypsum, plaster, porcelain, rubber, and suitable combinations thereof. It should also be noted that while the inner tubular member is illustrated as a round tube, other tubular shapes well known in the art may be utilized without departing from the scope of the invention.

The outer tubular member 26 includes a closed bottom end 28, an open top end 30 and an inner surface 32 defining an inner diameter. The inner surface 32 of the outer tubular member is sized to surround the outer diameter 18 of the inner tubular member 12 with a gap therebetween. Both the inner and outer tubular members 12, 26 have a length sufficient to accept the barrel portion 22 of a bat member 11. The outer tubular member is preferably constructed of a polymeric material such as plastic. However, other materials having suitable insulating or reflective properties may be utilized without departing from the scope of the invention.

A radiant heating element 24 is constructed and arranged to extend substantially around the outer surface 18 of the inner tubular member 12 and inside of the outer tubular member. The heating element is generally flexible in nature and utilizes alternating current for production of the radiant heat. Radiant heat transfer differs from both conduction and convection in that a medium, e.g. fluid, is not required to transfer the heat. In general, radiant heat transfer is an electromagnetic phenomenon similar to the transmission of light, x-rays, and radio waves. In operation, thermal radiation from the radiant heating element is directed through the inner tubular member to the barrel portion of the bat for warming the bat to a temperature above ambient temperature. A net interchange of heat occurs when the absorption of radiant energy by the bat exceeds the energy that it is radiating.

Figure 1:
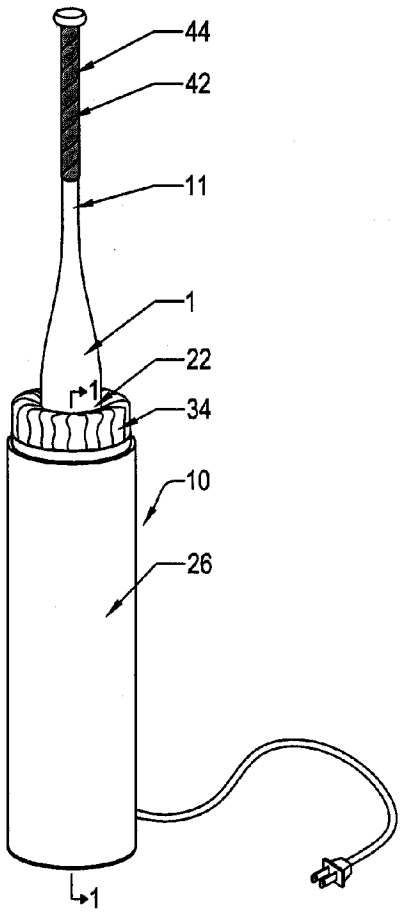
FIG. 1 is a perspective view, illustrating one embodiment of the instant invention.
Figure 3:
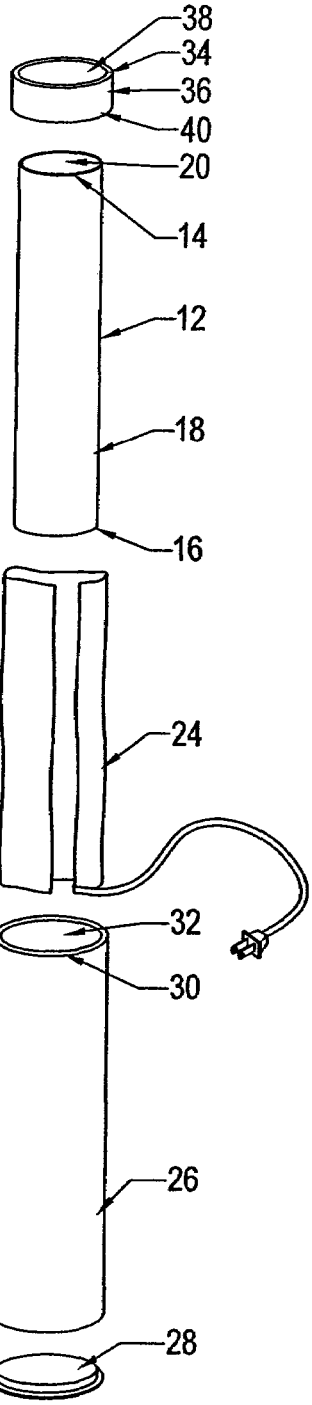
FIG. 3 is an exploded perspective view of one embodiment of the instant invention.
Figure 4:
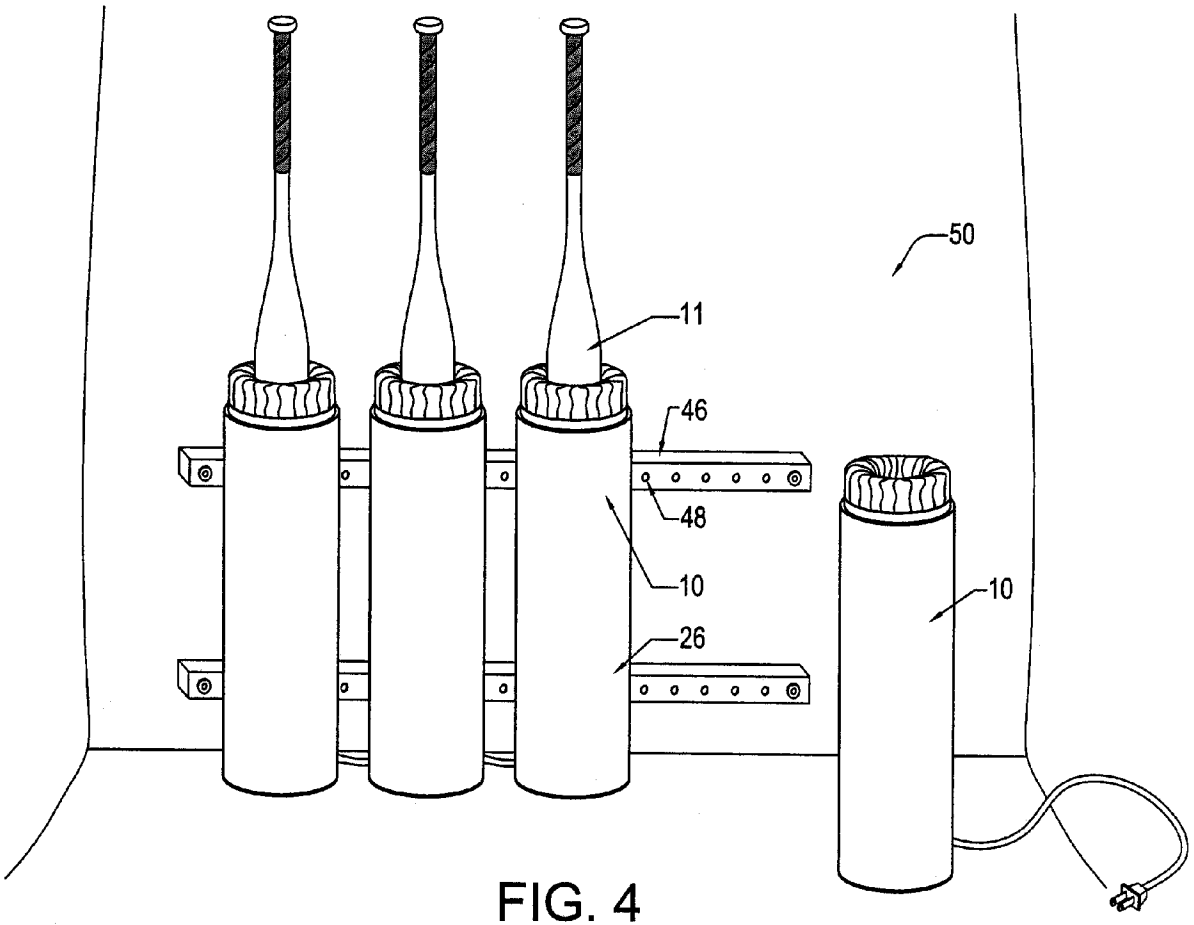
FIG. 4 is a perspective partially exploded view illustrating a plurality of bat warmers secured to a pair of rail members.

One embodiment of the instant invention includes a heat seal 34. The heat seal includes an outer diameter portion 36 and an inner diameter portion 38. The outer diameter may be constructed with a depending lip 40 (FIG. 3) sized to cooperate with either the inner or outer tubular members for securing the heat seal to the bat warmer. The inner diameter 38 is constructed and arranged to cooperate with the barrel portion of the bat. The heat seal may be constructed of a suitable rigid or flexible material, such as plastic (FIG. 3), or alternatively the heat seal may be constructed of a resilient rubber or cloth material as shown in FIGS. 1, 2 and 4. The heat seal allows bats to be easily inserted or removed from the bat warmer without opening an enclosure or removing a lid as shown in the prior art. In addition, the heat seal keeps the handle portion 42 of the bat 11 cooler than the barrel portion of the bat. This extends the useful life of the bat by protecting the polymeric grip 44 from repeated heat cycles.

Referring to FIG. 4, the bat warmer of the instant invention provides a modular construction that allows one or a plurality of bat warmers to be utilized. As shown in FIG. 4, individual or a plurality of bat warmers 10 may be secured to mounting rail(s) 46 with suitable fasteners. The mounting rails are preferably constructed and arranged to extend at a substantially perpendicular relationship with respect to each of said bat warmers. The rails include a plurality of apertures 48 that allow the bat warmers to be attached thereto. The apertures may also be utilized to attach the rails to a vertical surface 50 which may be a wall, fence or the like.

Figure 5:
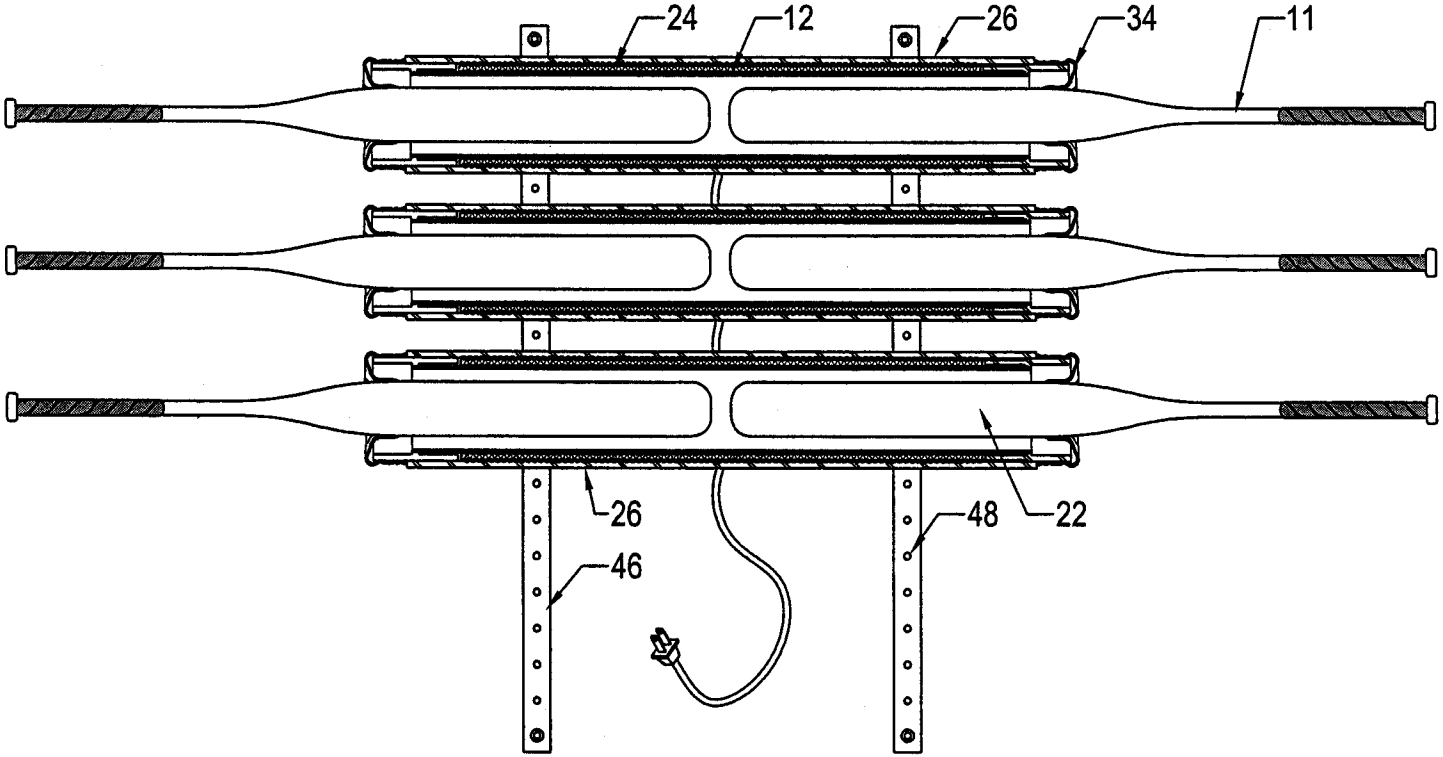
FIG. 5 is a front plan view partially in section illustrating one embodiment of the instant invention.
Figure 6:
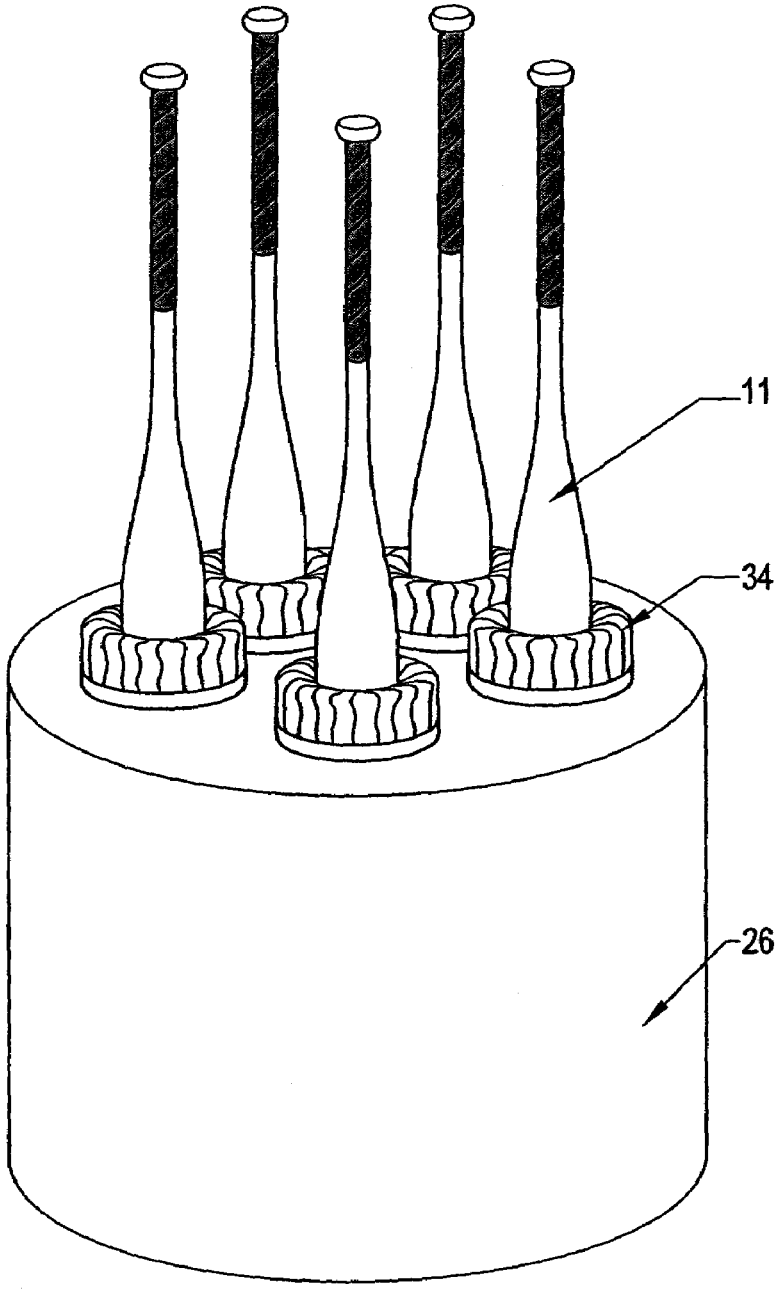
FIG. 6 is a perspective view of one embodiment of the instant invention.

Referring to FIGS. 5 and 6, alternative embodiments of the instant invention are illustrated. As shown in FIG. 5 one or a plurality of bat warmers 10 may be secured to mounting rails 46 in a horizontal orientation with suitable fasteners. The rails may then be secured to a substantially vertical surface. Within this embodiment both ends of the bat warmer are constructed and arranged to allow the barrel portion of one or two bat 11 to be placed therein. Heat seals 34 are preferably secured to each of the open ends whereby the radiant heat is retained within the bat warmer. As shown in FIG. 6 a plurality of bat warmers may be placed in a circular arrangement within an enlarged outer tubular member. In this embodiment the radiant heating elements may be arranged to extend around each individual bat or alternatively one radiant heating element may circumscribe the plurality of bats while a second radiant heating element inscribes the plurality of bats.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A bat warmer for warming a metal baseball or softball bat comprising:

an inner tubular member constructed and arranged to be substantially transparent to heat transmitted radiantly, said inner tubular member having an open top end, an open bottom end, an outer surface and an inner surface defining an inner diameter, wherein said inner diameter of said inner tubular member is sized to fit around an outer surface of a bat member, wherein said inner tubular member has a length sufficient to accept a barrel portion of a bat;

a radiant heating element for producing thermal radiation, said radiant heating element constructed and arranged to extend substantially around the outer surface of said inner tubular member, said thermal radiation produced by said radiant heating element being directed through said inner tubular member to said barrel portion of said bat for warming said bat to a temperature above ambient temperature;

an outer tubular member having a closed bottom end, an open top end and an inner surface defining an inner diameter, said inner diameter being substantially reflective to heat transmitted radiantly, wherein said inner surface of said outer tubular member is sized to surround said outer diameter of said inner tubular member with a gap therebetween, wherein said outer tubular member has a length sufficient to accept the barrel portion of a bat, wherein said radiant heating element is constructed and arranged to fit within said gap between said inner and said outer tubular members.

2. The bat warmer of claim 1 wherein said open bottom end of said inner tubular member is closed.

3. The bat warmer of claim 1 wherein said top end of said tubular member includes a heat seal.

4. The bat warmer of claim 3 wherein said heat seal includes an outer diameter and an inner diameter, wherein said outer diameter is constructed and arranged to cooperate with said tubular member for securing said heat seal to said tubular member, wherein said inner diameter is constructed and arranged to cooperate with said barrel of said bat to maintain a handle portion of said bat at a lower temperature than said barrel portion of said bat.

5. The bat warmer of claim 4 wherein said heat seal is constructed from a resilient material.

6. The bat warmer of claim 4 wherein said heat seal is constructed from a cloth material.

7. The bat warmer of claim 1 wherein said radiant heating element is powered with alternating current.

8. The bat warmer of claim 1 wherein said inner tubular member is constructed from metal.

9. The bat warmer of claim 1 wherein said inner tubular member is constructed from refractory material.

10. The bat warmer of claim 1 wherein said inner tubular member is constructed from polymeric material.

11. The bat warmer of claim 1 including at least one mounting rail, said at least one mounting rail constructed and arranged for mounting a plurality of bat warmers in a substantially linear arrangement, wherein said at least one mounting rail is constructed and arranged to extend at a substantially perpendicular relationship with respect to each of said bat warmers.

12. The bat warmer of claim 1 including two mounting rails, wherein said mounting rails are constructed and arranged to cooperate with a substantially vertical surface.

13. The bat warmer of claim 1 wherein said inner tubular member is constructed and arranged to include a length sufficient to accept a barrel portion of two bats, wherein one bat is placed through said top end and wherein one bat is placed through said bottom end;

whereby said thermal radiation from said radiant heating element is directed through said inner tubular member to said barrel portions of said bats for warming said bats to a temperature above ambient temperature.

14. The bat warmer of claim 3 wherein said inner tubular member includes a heat seal secured to each end thereof, said heat seal including an outer diameter and an inner diameter, wherein said outer diameter is constructed and arranged to cooperate with said inner tubular member for securing said heat seal to said inner tubular member, wherein said inner diameter is constructed and arranged to cooperate with said barrel of said bat to maintain a handle portion of said bat at a lower temperature than said barrel portion of said bat.

* * * * *